US008020391B2

(12) United States Patent
Swofford et al.

(10) Patent No.: US 8,020,391 B2
(45) Date of Patent: Sep. 20, 2011

(54) REFRIGERATION DEVICE CONTROL SYSTEM

(75) Inventors: Timothy Dean Swofford, Midlothian, VA (US); Angel Antonio Barreto, Petersburg, VA (US)

(73) Assignee: Hill Phoenix, Inc., Conyers, GA (US)

( * ) Notice: Subject to any disclaimer, the term of this patent is extended or adjusted under 35 U.S.C. 154(b) by 428 days.

(21) Appl. No.: 12/324,708

(22) Filed: Nov. 26, 2008

(65) Prior Publication Data

US 2009/0133416 A1 May 28, 2009

Related U.S. Application Data

(60) Provisional application No. 61/004,479, filed on Nov. 28, 2007.

(51) Int. Cl.
*F25B 49/00* (2006.01)
*F25B 41/04* (2006.01)
*A47F 3/04* (2006.01)

(52) U.S. Cl. ..... 62/126; 62/225; 62/246

(58) Field of Classification Search ..... 62/126, 62/225, 246, 434; 700/275
See application file for complete search history.

(56) References Cited

U.S. PATENT DOCUMENTS 4,151,723 A * 5/1979 Gardner ..... 62/155
5,323,621 A 6/1994 Subera et al.
5,921,096 A 7/1999 Warren
6,185,951 B1 2/2001 Lane et al.
6,883,343 B2 4/2005 Lane et al.
6,889,514 B2 5/2005 Lane et al.
6,889,518 B2 5/2005 Lane et al.
6,945,059 B1 9/2005 Reason et al.
6,981,385 B2 1/2006 Arshansky et al.
7,000,422 B2 2/2006 Street et al.
7,013,661 B2 3/2006 Gatling et al.
7,047,753 B2 5/2006 Street et al.
7,065,979 B2 6/2006 Arshansky et al.
7,089,088 B2 8/2006 Terry et al.
7,134,294 B2 11/2006 Singh et al.
7,152,415 B2 12/2006 Micak et al.
7,159,413 B2 1/2007 Dail
7,216,500 B2 5/2007 Schwichtenberg et al.
7,257,376 B2 8/2007 Reudink
7,270,278 B2 9/2007 Street et al.
7,357,000 B2 4/2008 Schwichtenberg et al.
7,421,850 B2 9/2008 Street et al.
2005/0193746 A1 9/2005 Eisenhower
2005/0193752 A1 9/2005 Eisenhower et al.
2005/0204757 A1 9/2005 Micak et al.
2005/0204759 A1 9/2005 Singh et al.
2006/0112703 A1 6/2006 Singh et al.
2006/0130501 A1 * 6/2006 Singh et al. ..... 62/183
2007/0006604 A1 1/2007 Behr
2007/0089454 A1 4/2007 Shapiro
2007/0227167 A1 10/2007 Shapiro
2007/0235681 A1 10/2007 Fukushima
(Continued)

*Primary Examiner* — Chen Wen Jiang
(74) *Attorney, Agent, or Firm* — Foley & Lardner LLP

(57) ABSTRACT

A refrigeration device includes a control device and a multiple cooling elements. A supply header delivers refrigerant to the cooling elements and a return header returns refrigerant from the cooling elements. A single pressure sensor provides a signal representative of a pressure of the refrigerant in the return header to the control device, and a single temperature sensor provides a signal representative of a temperature of the refrigerant in the return header to the control device. The control device provides an output signal to control each of the cooling elements, in response to the signals from the single temperature sensor and the single pressure sensor.

20 Claims, 3 Drawing Sheets

U.S. PATENT DOCUMENTS

2008/0148751 A1 6/2008 Swofford
2008/0202131 A1 8/2008 Brody
2008/0209921 A1 9/2008 Swofford
2008/0276636 A1 11/2008 Thybo et al.

* cited by examiner

REFRIGERATION DEVICE CONTROL SYSTEM

CROSS REFERENCE TO RELATED APPLICATIONS

This application claims the benefit of priority under 35 U.S.C. 119(e) of U.S. Provisional Application No. 61/004,479, having a filing date of Nov. 28, 2007, titled "Refrigeration Device Control System," the complete disclosure of which is hereby incorporated by reference.

FIELD

The present invention relates to a refrigeration device. The present invention relates more particularly to a refrigeration device having multiple cooling elements. The present invention relates to a refrigeration device having multiple cooling elements that are controlled using a single measurement of refrigerant temperature and pressure.

BACKGROUND

It is generally known to provide refrigeration devices (e.g. temperature controlled cases, refrigerated storage units, merchandisers, coolers, etc.) having a refrigeration system for circulating a refrigerant or coolant through one or more cooling elements (e.g. evaporators, heat exchangers, cooling coils, etc.) within the case to maintain items (such as food products and the like) within a certain desirable temperature range. Such refrigeration devices often include multiple cooling elements, which are typically controlled individually by a temperature and pressure measurement of the refrigerant associated with each cooling element. The present invention provides a control system for a refrigeration device that controls multiple cooling elements within a single refrigeration device using a single measurement of the temperature and of the pressure of the refrigerant circulated through the cooling elements.

SUMMARY

According to one embodiment, a refrigeration device includes a control device and multiple cooling elements. A supply header delivers refrigerant to the cooling elements and a return header returns refrigerant from the cooling elements. A single pressure sensor provides a signal representative of a pressure of the refrigerant in the return header to the control device, and a single temperature sensor provides a signal representative of a temperature of the refrigerant in the return header to the control device. The control device provides an output signal to control each of the cooling elements, in response to the signals from the single temperature sensor and the single pressure sensor.

According to another embodiment, a refrigeration device includes an enclosure defining a space for storage of temperature-controlled objects and cooling elements operable to provide cooling to the space. The device also includes a refrigeration system including a return header to return refrigerant from the cooling elements to a compressor, and a condenser to condense the refrigerant, and a supply header to deliver the refrigerant to the cooling elements. A single pressure sensor provides a signal representative of a pressure of the refrigerant in the return header, and a single temperature sensor provides a signal representative of a temperature of the refrigerant in the return header. A control device receives the signal representative of temperature and the signal representative of pressure and provides an output signal to control a superheat valve for each of the cooling elements. A signal splitting device splits the output signal into separate branch signals for each superheat valve. Boosting of the branch signals, if necessary, may also be provided by the signal splitting device, or by a separate device. The branch signals may all be substantially identical (e.g. for cooling elements that are substantially the same size or capacity) or the signals may be different (e.g. for cooling elements that are not the same size capacity or demand, etc.).

According to another embodiment, a method of controlling a refrigeration device having cooling elements includes providing a supply header to deliver refrigerant to the cooling elements, providing a return header to return refrigerant from the cooling elements, providing a single pressure sensor to generate a signal representative of a pressure of the refrigerant in the return header, providing a single temperature sensor to generate a signal representative of a temperature of the refrigerant in the return header, providing a control device to receive the signals representative of pressure and temperature and to provide an output signal to control each of the cooling elements; and splitting the output signal into substantially identical branch signals for controlling a superheat valve associated with each cooling element.

DETAILED DESCRIPTION

Referring to the FIGURES, a refrigeration system for use with one or more cooling elements (e.g. coils, finned-coils, heat exchangers, flow-through pans, etc.) in a refrigeration device such as a temperature controlled case is shown according to one embodiment. The temperature controlled case is shown to have a refrigeration loop having a compressor, condenser, expansion device and suitable sensors for circulating a fluid (such as a refrigerant or coolant) through the cooling element to maintain the temperature of products, such as food products within a storage area of the refrigeration device, at a relatively constant storage temperature. The control system is shown to include a control module that interfaces with appropriate components of the refrigeration device. The control module is shown for use with a single refrigeration device, but may be used with multiple refrigeration devices. The control module receives one signal representative of a temperature of the refrigerant at the outlet and one signal representative of a pressure of the refrigerant at the outlet and provides an output signal to control (or regulate) the position (i.e. the amount open or closed) of a valve (such as a superheat control valve) located at the inlet of each cooling element in the refrigeration device. Although the system is shown and described by way of example for use with a single refrigeration device in the form of an open-front display case having three cooling elements, the system may be used with any type or number of refrigeration devices having more than one cooling element. Accordingly, all such modifications are intended to be within the scope of the invention as disclosed in reference to the embodiments illustrated and described herein.

Figure 1:
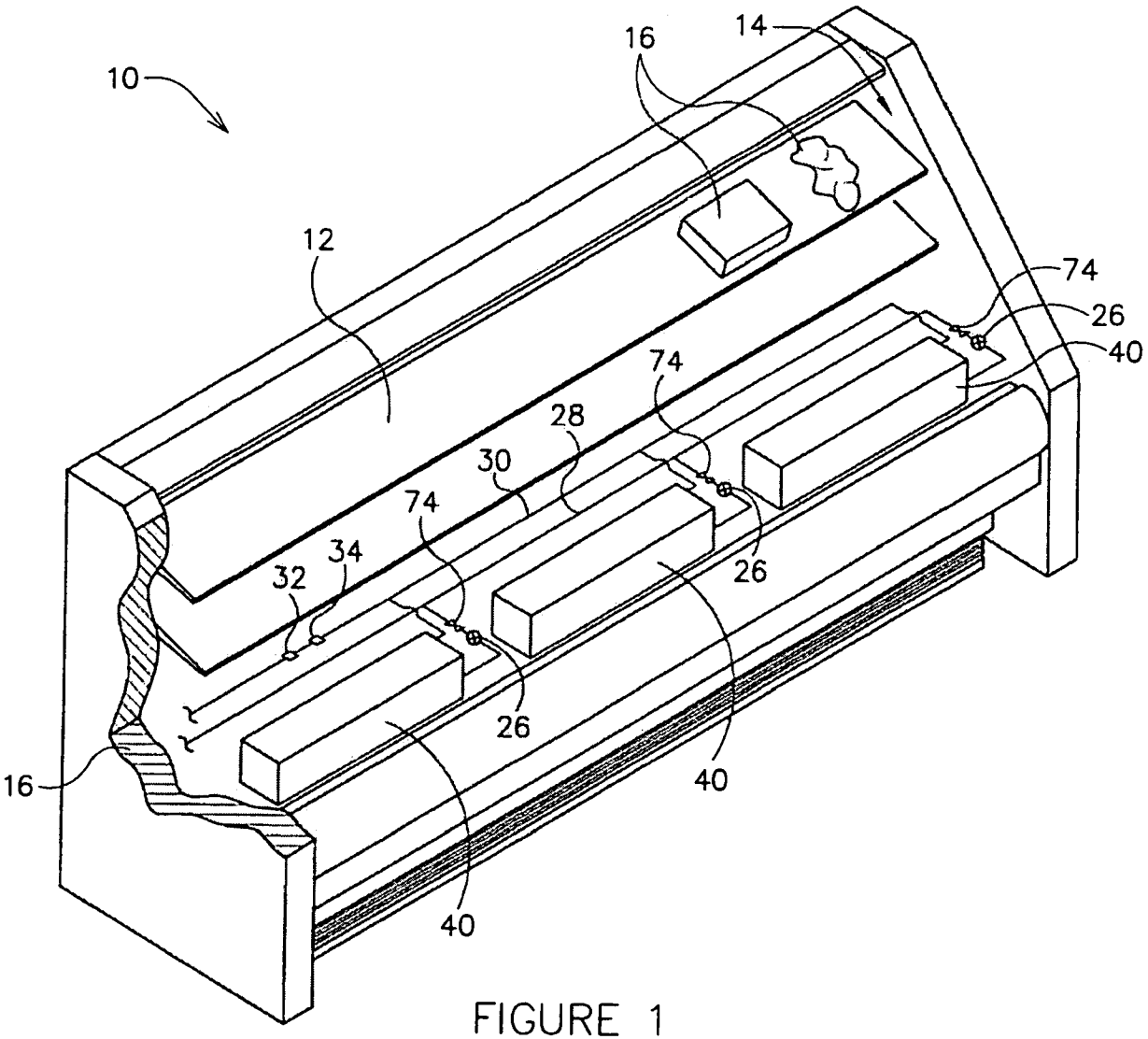
FIG. 1 is a schematic image of a perspective view of a refrigeration device according to an exemplary embodiment.

Referring to FIG. 1, a refrigeration device is shown schematically as a temperature controlled case 10 according to an exemplary embodiment. The case 10 is shown as an open front display case, but may be any suitable enclosure for maintaining a temperature controlled environment for the storage of objects such as food products and the like (such as service-type cases, or open top cases, closed door cases, walk-in coolers, etc.). The case is shown to include a product support surface 12 within an airspace 14 for storage of products 16, and cooling element(s) 40 configured to cool air circulated with the airspace 14 by a fan (not shown). According to alternative embodiments, the cooling element(s) may be positioned at any suitable location within the airspace and the air may be circulated by any type of forced or natural circulation.

Figure 2:
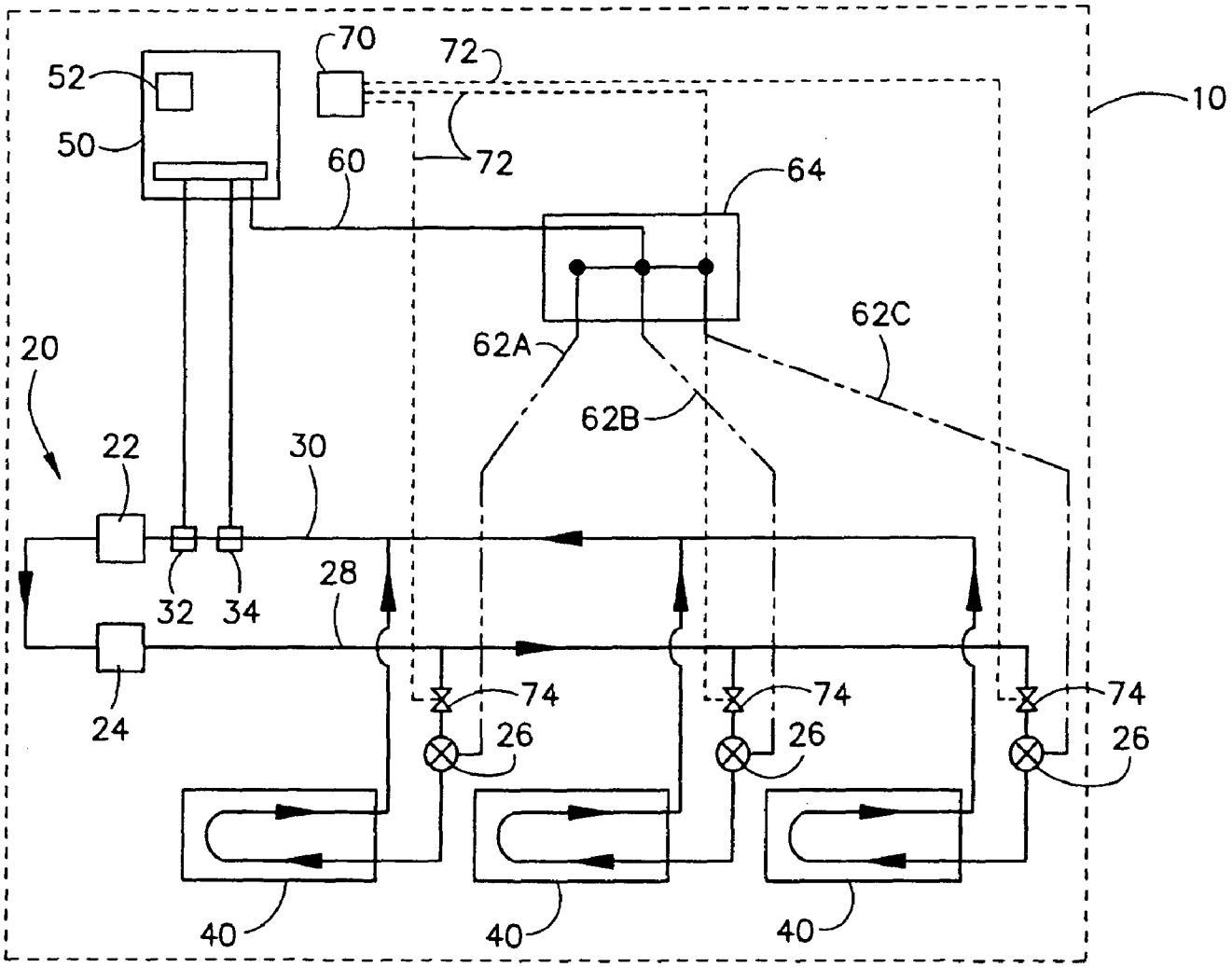
FIG. 2 is a schematic image of a diagram of a control system and defrost system for a refrigeration device according to an exemplary embodiment.

Referring to FIGS. 1 and 2, a refrigerant system 20 circulates a refrigerant through a closed loop system shown to include a compressor 22 for compressing a refrigerant vapor, a condenser 24 for cooling and condensing the compressed refrigerant vapor, an expansion metering device (e.g. throttle valve, electronic expansion valve, etc.—shown as a superheat valve 26) for "expanding" the liquid refrigerant to a low-temperature or medium-temperature saturated liquid-vapor mixture for use in cooling elements 40 for cooling airspace 14 and products 16 within the case 10. According to a preferred embodiment, the refrigerant is a commercially available refrigerant such as R-404A, but may be any suitable refrigerant for use with a refrigeration device. The refrigeration system 20 may be self-contained within the case (as shown schematically in FIG. 2). Alternatively, a portion of the refrigeration system may be located remotely from the case (e.g. on a rack or in an equipment room for use in circulating refrigerant to multiple refrigeration devices).

According to one embodiment, the refrigerant flows through a refrigerant supply line 28 (e.g. "liquid line" etc.) to the superheat valve 26 at a first flow rate and is expanded by the superheat valves 26 to form a liquid-vapor mixture at a "saturation temperature" within the cooling elements 40 during a cooling mode of operation to maintain the temperature of the food products 16 at a desired storage or display temperature, consistent with store or industry food safety codes or guidelines.

According to one exemplary embodiment for a medium-temperature system, the saturation temperature of the refrigerant is typically within a range of approximately 17-32 degrees F., and more particularly within a range of 22-29 degrees F. and is intended to maintain at least a portion of each cooling element 40 at a temperature corresponding approximately to the refrigerant's saturation temperature during the cooling mode. According to another exemplary embodiment for a low-temperature system, the saturation temperature of the refrigerant is typically within a range of approximately minus (−)22 to minus (−)5 degrees F., and is intended to maintain at least a portion of each cooling element 40 at a temperature corresponding approximately to the refrigerant's saturation temperature during the cooling mode. However, the temperature ranges are described by way of example and any temperature range suitable for use in a refrigeration device for a desired application may be used. As the saturated liquid-vapor mixture of refrigerant progresses through the cooling element(s) 40 and absorbs heat from the air circulated from the airspace 14, the vapor percentage of the liquid-vapor mixture increases, and usually becomes vaporized. When the refrigerant is vaporized within a portion of the cooling elements 40 (e.g. usually at or near an outlet portion of the cooling element, such as the last one or several tube passes of a coil), the refrigerant temperature increases above the refrigerant's saturation temperature as the refrigerant continues to circulate through the cooling elements 40. The amount of temperature increase above the saturation temperature is referred to herein as the "superheat temperature."

During the cooling mode of operation, the superheat valve 26 is configured to modulate a flow rate of the refrigerant corresponding to the duty or demand experienced by the case 10. The flow rate may be increased during high demand and the flow rate may be decreased during low demand. For example, according to one embodiment where the saturation temperature of refrigerant entering the cooling elements 40 from the superheat valve 26 is controlled at approximately 22 degrees F., the flow rate of refrigerant may be modulated to permit a superheat temperature at the exit of the cooling elements 40 to be maintained within a range of approximately 3-8 degrees F. Similarly, for embodiments having other saturation temperatures, the superheat valve is modulated accordingly.

Referring further to FIG. 2, a control module 50 is provided to modulate the position of the superheat valve 26 for each cooling element during the cooling mode and a defrost mode, according to an exemplary embodiment. Control module 50 includes a suitable computing device (such as a microprocessor or programmable logic controller 52) configured to receive one signal representative of temperature and one signal representative of pressure of the vaporized refrigerant in a refrigerant return line (or "suction" line) 30 from the cooling elements 40 and to provide an output signal 60 used for controlling the position of each superheat valve 26 for each cooling element 40 to maintain the superheat temperature of the refrigerant within the cooling element 40 at a desired range for both the cooling mode and/or the defrost mode of operation.

Referring further to FIG. 2, a temperature/pressure sensing arrangement is shown to include a single temperature sensor 32 and a single pressure sensor 34 provided on refrigerant return line 30 adjacent to the exit of the cooling elements 40. The pressure sensor 34 provides a signal representative of refrigerant pressure to the control module 50, which calculates a corresponding saturation temperature (T sat) of the refrigerant at the exit of the cooling elements 40. The temperature sensor 32 provides a signal representative of actual temperature of the refrigerant at the exit of the cooling elements 40 (T exit). The control module 50 calculates the difference between T exit and T sat to determine the actual superheat temperature of the refrigerant. The control module 50 compares the actual superheat temperature of the refrigerant to a predetermined desired range or setpoint for the superheat temperature and sends an output signal to modulate the position of the superheat valve 26 to attain or maintain the desired superheat temperature at the exit of the cooling element(s) 40. According to a currently preferred embodiment, the temperature sensor 32 is a commercially available thermistor (but could be a thermocouple or RTD or the like) and the pressure sensor 34 is a commercially available pressure transducer.

Referring further to FIG. 2, the output signal 60 is provided to each superheat valve 60. Output signal 60 is shown entering a circuit board 64, which "splits" the output signal into separate branch signals for controlling each superheat valve. As shown in FIG. 2, signal 60 is "split" into separate signals 62A, 62B, 62C that control the superheat valve 26 for each cooling element 40. Circuit board 64 may also include an amplification device or signal boosting device for increasing the strength of the branch signals (if necessary), particularly in cases where there are an increased number of branch signals corresponding to an increased number of cooling elements. According to an alternative embodiment, a circuit board may be omitted and a wire or signal splitter device may be used, particularly in embodiments where branch signal strength is sufficient to operate superheat valve 26 without boosting or amplification. According to the illustrated embodiment, a single pressure signal and a single temperature signal may be used to control all of the cooling elements in any one or more refrigeration devices that are intended to operate at approximately the same temperature.

According to one embodiment with a case having a refrigeration system 20 configured for a saturation temperature of approximately 22 degrees F., the control module 50 is configured to modulate each of the superheat valves 26 during a cooling mode of operation to maintain a superheat temperature or refrigerant near the outlet of the cooling elements 40 within the range of approximately 3-8 degrees F.

Referring further to FIG. 2, a defrost system is shown according to one embodiment to include a defrost controller 70 operable to initiate a defrost mode of operation for cooling coils 40 by sending a signal 72 to close a defrost valve 74 (e.g. solenoid valves, etc.) associated with each cooling element 40 to interrupt the flow of refrigerant to the cooling element (e.g. "time-off"). According to one embodiment, defrosting of cooling elements 40 may be accomplished sequentially (e.g. in a "staggered" manner or the like) so that only one cooling element is defrosting at a given time to minimize thermal shock of the products within the refrigeration device. In addition to stopping the flow of refrigerant to the cooling elements for a sufficient period of time to allow frost and/or ice to melt, the defrost mode of operation may include any one or a combination of other defrost methods such as energizing electrical heating elements (e.g. wires, etc.—not shown) formed in or located adjacent to the cooling elements, or circulating a "warmed" fluid through the cooling elements (such as may be warmed by "hot gas" etc.) or other suitable method. The defrost mode may be initiated and terminated based on suitable signals initiated or received by the defrost control device (e.g. on a demand-based signal), or by a timer, or other suitable method. Defrost controller 70 is shown as a separate component from control system 50 and may located at any suitable location proximate the refrigeration device, or in a remote location such an equipment or condensing unit rack for the refrigeration device, etc. However, according to alternative embodiments, the defrost controller may be integrated with the control system (e.g. provided on the same circuit board, etc.).

Figure 3:
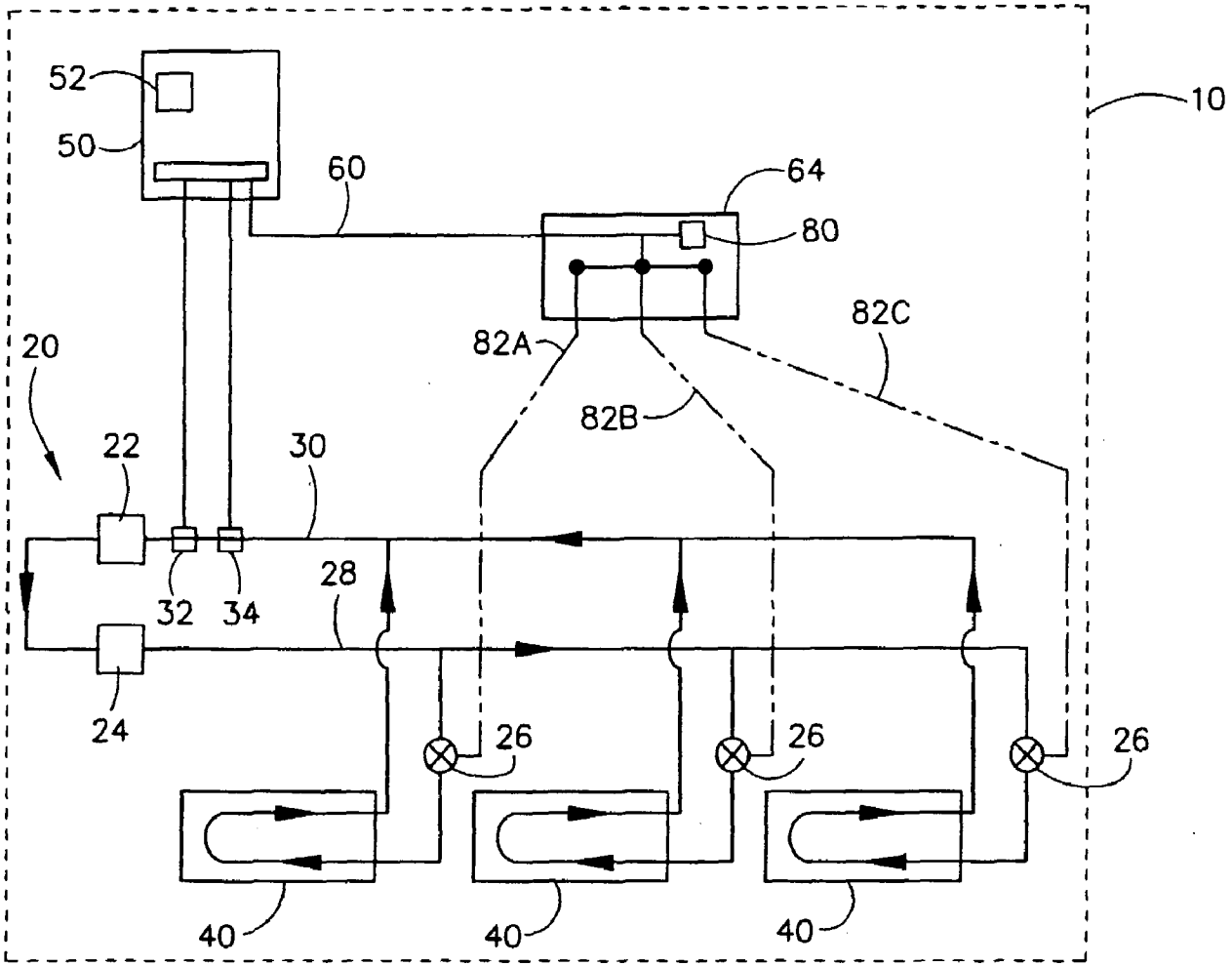
FIG. 3 is a schematic image of a diagram of a defrost system for a refrigeration device according to another exemplary embodiment.

Referring further to FIG. 3, a defrost system is shown according to another embodiment to include a defrost controller 80 integrated with the signal splitting/boosting circuit board 64, and operable to initiate a defrost mode of operation for cooling coils 40 by sending a signal 82(A, B, C) to close superheat valves 26 to interrupt the flow of refrigerant to the cooling coil (e.g. "time-off"). Although the defrost controller 80 is shown to be physically integrated with the splitter/booster circuit board 64, the defrost controller may also be located at a separate location and interconnected with the circuit board (through wired connection, wireless communication, etc.). Circuit board 64 may be configured (e.g. by a signal from the defrost controller, or a timer or a suitable demand-based condition) to close superheat valves 26 according to a predetermined protocol (e.g. in a "staggered" or sequential manner, etc.) for a period of time sufficient to permit a desired level of defrosting of the outer surface of the cooling elements 40. The circuit board 64 may provide a signal to close valves 26 completely, or to close valves 26 to an intermediate position that is sufficient to permit the superheat temperature of the refrigerant in the cooling element to increase to a temperature above 32 degrees F. to facilitate melting of frost on the outside surfaces of the cooling element.

It is also important to note that the construction and arrangement of the elements of the control system for a refrigeration device as shown schematically in the FIGURES is illustrative only. Although only a few embodiments have been described in detail in this disclosure, those skilled in the art who review this disclosure will readily appreciate that many modifications are possible (e.g., variations in location of temperature and/or pressure sensors, values of parameters, etc.) without materially departing from the novel teachings and advantages of the subject matter recited.

It should also be noted that the control module may include a processor such as a microprocessor, programmable logic controller or the like for receiving and monitoring input signals, sending output signals, permitting change or adjustment of set points, providing appropriate indications (e.g. alarms, status, temperature, fluid flow rates, mode of operation (such as cooling or defrost), etc.) and to interface with local or remote monitoring equipment or stations. The control module may also be configured to initiate and terminate a defrost mode of operation in any suitable manner. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. A refrigeration device, comprising:

a control device;

a plurality of cooling elements;

a supply header configured to deliver refrigerant to the cooling elements;

a return header configured to return refrigerant from the cooling elements;

a single pressure sensor operable to provide a signal representative of a pressure of the refrigerant in the return header to the control device;

a single temperature sensor operable to provide a signal representative of a temperature of the refrigerant in the return header to the control device;

the control device operable to provide an output signal to control each of the cooling elements, responsive to the signals from the single temperature sensor and the single pressure sensor;

a circuit board operable to convert the output signal into a plurality of branch signals corresponding to each of the cooling elements;

a superheat valve associated with each of the cooling elements and configured to operate in response to the branch signals.

2. The refrigeration device of claim 1 wherein the plurality of branch signals are substantially the same.

3. The refrigeration device of claim 1 wherein the circuit board is operable to amplify the plurality of branch signals.

4. The refrigeration device of claim 3 wherein the circuit board is operable to defrost the cooling elements by using the branch signals to close the superheat valves in a predetermined order.

5. The refrigeration device of claim 1 further comprising a defrost valve associated with each of the cooling elements, and operable to interrupt flow of the refrigerant to any one of the cooling elements in response to a defrost signal from the control device.

6. The refrigeration device of claim 5 wherein the control device is configured to provide a defrost signal to only one defrost valve at a time, for defrosting of only one cooling element at a time.

7. A refrigeration device, comprising:

an enclosure defining a space configured for storage of temperature-controlled objects;

a plurality of cooling elements operable to provide cooling to the space;

a refrigeration system including a return header configured to return refrigerant from the cooling elements to a compressor, and a condenser configured to condense the refrigerant, and a supply header configured to deliver the refrigerant to the cooling elements;

a single pressure sensor operable to provide a signal representative of a pressure of the refrigerant in the return header;

a single temperature sensor operable to provide a signal representative of a temperature of the refrigerant in the return header;

a control device operable to receive the signal representative of temperature and the signal representative of pressure and provide an output signal to control a superheat valve for each of the cooling elements; and a signal splitting device operable to split the output signal into separate branch signals for each superheat valve.

8. The refrigeration device of claim 7 wherein the signal splitting device is a circuit board, and the circuit board is operable to boost a strength of the separate branch signals.

9. The refrigeration device of claim 8 wherein the superheat valves modulate in response to the separate branch signals to maintain a superheat temperature of the refrigerant exiting the cooling elements within a predetermined range.

10. The refrigeration device of claim 7 wherein the signal splitting device is operable to defrost the cooling elements by using the branch signals to close the superheat valves in a predetermined order.

11. The refrigeration device of claim 7 further comprising a defrost valve provided on an inlet to each of the cooling elements, and operable to interrupt flow of the refrigerant to any one of the cooling elements in response to a defrost signal from the control device.

12. The refrigeration device of claim 11 wherein the control device is configured to provide a defrost signal to only one defrost valve at a time, for defrosting of only one cooling element at a time.

13. The refrigeration device of claim 12 wherein the defrost valve and the superheat valve are adjacent to one another on the inlet to each of the cooling elements.

14. A method of controlling a refrigeration device having a plurality of cooling elements, comprising:

providing a supply header configured to deliver refrigerant to the cooling elements;

providing a return header configured to return refrigerant from the cooling elements;

providing a single pressure sensor operable to generate a signal representative of a pressure of the refrigerant in the return header;

providing a single temperature sensor operable to generate a signal representative of a temperature of the refrigerant in the return header;

providing a control device operable to receive the signals representative of pressure and temperature and to provide an output signal to control each of the cooling elements; and splitting the output signal into branch signals for controlling a superheat valve associated with each cooling element.

15. The method of claim 14 further comprising the step of boosting the branch signals prior to delivery to the superheat valves.

16. The method of claim 15 further comprising the step of sending a defrost signal from the control device to a defrost valve for each cooling element in a staggered sequence so that at least one cooling element operates in a cooling mode while the other cooling elements operate in a defrost mode.

17. The method of claim 14 further comprising the step of using the branch signals to defrost the cooling elements by closing the superheat valves in a predetermined order.

18. A refrigeration device, comprising:

a control device;

a plurality of cooling elements;

a supply header configured to deliver refrigerant to the cooling elements;

a return header configured to return refrigerant from the cooling elements;

a single pressure sensor operable to provide a signal representative of a pressure of the refrigerant in the return header to the control device;

a single temperature sensor operable to provide a signal representative of a temperature of the refrigerant in the return header to the control device;

the control device operable to provide an output signal to control each of the cooling elements, responsive to the signals from the single temperature sensor and the single pressure sensor;

a superheat valve associated with each of the cooling elements; and a circuit board operable to convert the output signal into a plurality of branch signals corresponding to each of the cooling elements and to defrost the cooling elements by using the branch signals to close the superheat valves in a predetermined order.

19. The refrigeration device of claim 18 wherein the plurality of branch signals are substantially the same.

20. The refrigeration device of claim 18 wherein the circuit board is operable to amplify the plurality of branch signals.

* * * * *